US009565976B2

(12) United States Patent
Sisto

(10) Patent No.: US 9,565,976 B2
(45) Date of Patent: Feb. 14, 2017

(54) CURVED SHOWER ROD ATTACHMENT

(71) Applicant: WINGITS INNOVATIONS, LLC, Bradley Beach, NJ (US)

(72) Inventor: Salvatore Sisto, Bradley Beach, NJ (US)

( * ) Notice: Subject to any disclaimer, the term of this patent is extended or adjusted under 35 U.S.C. 154(b) by 258 days.

(21) Appl. No.: 14/278,713

(22) Filed: May 15, 2014

(65) Prior Publication Data

US 2014/0338117 A1 Nov. 20, 2014

Related U.S. Application Data

(60) Provisional application No. 61/823,611, filed on May 15, 2013.

(51) Int. Cl.

| | |
|---|---|
| ***A47K 3/38*** | (2006.01) |
| ***A47H 1/02*** | (2006.01) |
| ***A47H 1/102*** | (2006.01) |

(52) U.S. Cl.

CPC . *A47K 3/38* (2013.01); *A47H 1/02* (2013.01); *A47H 1/102* (2013.01); *A47H 2001/0205* (2013.01)

(58) Field of Classification Search

CPC ... A47H 1/14; A47H 1/142; A47H 2001/0205

USPC ..... 248/261

See application file for complete search history.

(56) References Cited

U.S. PATENT DOCUMENTS

| | | | | |
|---|---|---|---|---|
| 2,056,874 | A * | 10/1936 | Updegraff | A47H 1/122 248/265 |
| 6,216,287 | B1 * | 4/2001 | Wise | A47K 3/38 4/610 |
| 7,222,376 | B1 * | 5/2007 | Gunning | A47K 3/38 248/262 |
| 2008/0099644 | A1 * | 5/2008 | Cross | A47H 1/122 248/261 |
| 2011/0024372 | A1 * | 2/2011 | Wu | A47K 3/38 211/45 |
| 2011/0147326 | A1 * | 6/2011 | Woolley, II | A47H 1/102 211/105.6 |

* cited by examiner

*Primary Examiner* — Janie Loeppke
(74) *Attorney, Agent, or Firm* — Gottlieb, Rackman & Reisman, PC

(57) ABSTRACT

A curved shower rod attachment assembly, which includes a first element that is adapted and configured for attachment to a surface and a second element that is securable to the first element and includes a protrusion that has an opening formed therein that extending at an angle and is configured to receive a shower rod. The dual channel interlocking bracket allows a curved shower rod to hinge within the attachment assembly to preclude rotation and sagging.

20 Claims, 11 Drawing Sheets

CURVED SHOWER ROD ATTACHMENT

CROSS-REFERENCE TO RELATED APPLICATION

This patent application claims benefit under 35 U.S.C. §119 to similarly-titled U.S. Provisional Patent Application No. 61/823,611, filed May 15, 2013, which is hereby incorporated by reference in its entirety as part of the present disclosure.

FIELD OF THE INVENTION

The present invention relates to an attachment assembly, and more particularly to an attachment assembly for a curved shower rod.

BACKGROUND OF THE INVENTION

Curved shower rod attachment assemblies that are intended to aid in contouring a shower curtain associated with a curved shower rod inwardly to contain water spray are known. For example, U.S. Pat. No. 6,216,287 discloses a curved shower curtain rod assembly. Unlike a straight shower rod, a curved rod, which is typically 5' to 6' in length, is subject to significant moment forces and in turn torsional forces at the bowed portion. Curved shower rods are typically connected to the wall brackets by a vertical hinge. However, vertical hinges allow for rotation of the bracket, which results in the curved rod sagging.

SUMMARY OF THE INVENTION

The present invention is directed to a curved shower rod attachment assembly that includes a dual channel interlocking bracket that allows a curved shower rod to hinge within the attachment assembly to preclude rotation and sagging and to ensure the rod is aligned properly with walls that may not be exactly parallel. The attachment assembly keeps a curved shower rod secure and in a desired position by minimizing rotation and moment forces applied to the shower rod.

In an embodiment, a curved shower rod attachment comprises a first element adapted and configured for attachment to a surface and a second element securable to the first element and including a protrusion extending at an angle therefrom which has an opening formed therein that is configured to receive a shower rod.

In another embodiment, a method of assembling a curved shower rod attachment is disclosed which, comprises the following steps: providing a curved shower rod attachment comprising a first element that includes a plurality of openings and a first channel defined by a first shoulder and a second shoulder that are spaced apart from each other and extend parallel to each other in a first direction from a first surface of the first element and outwardly from the first surface, a second element that includes a second channel defined by a first shoulder and a second shoulder that are spaced apart from each other and extend parallel to each other in a first direction from a first surface of the second element and outwardly from the first surface and a plurality of securing elements; sliding the first channel of the first element slides within the second channel of the second element until at least one end wall of the first element and the second element are flush with each other; and fastening the first element and the second element together.

DETAILED DESCRIPTION OF EMBODIMENTS OF THE INVENTION

Figure 1:
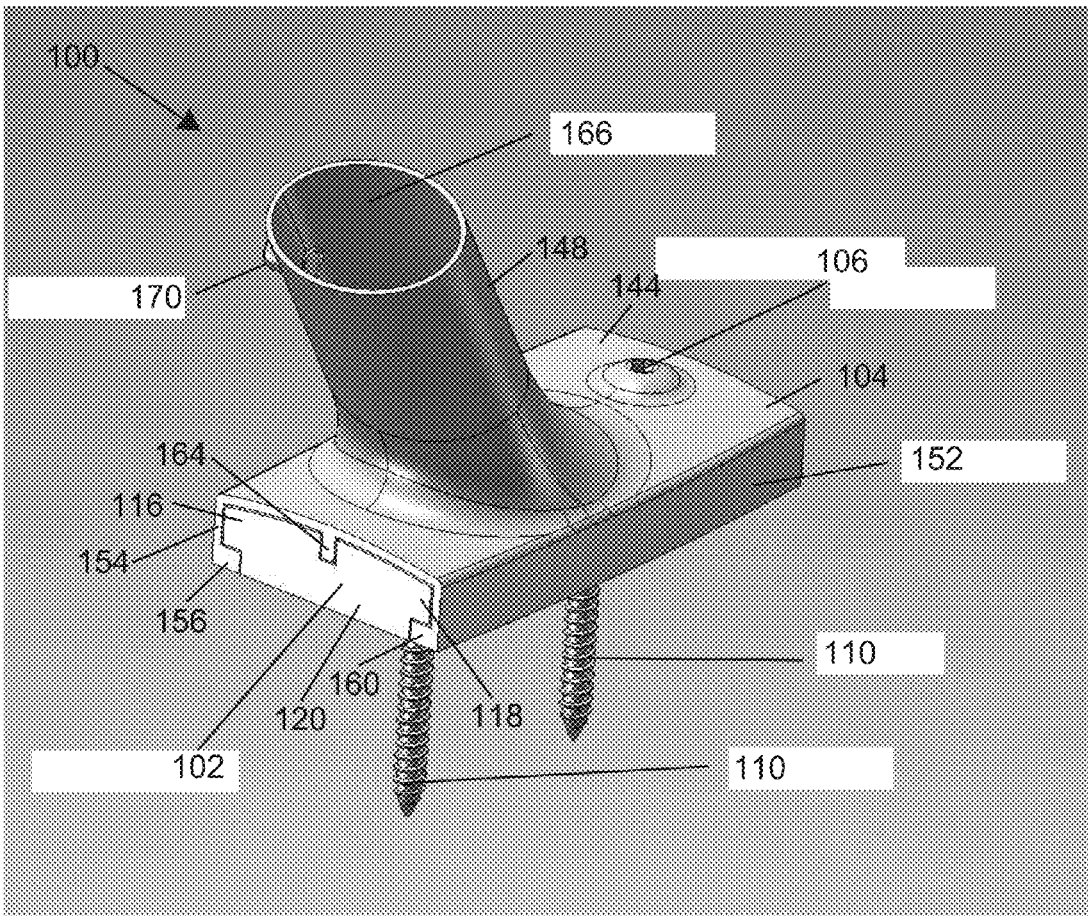
FIG. 1 is a perspective view of an embodiment of a curved shower rod attachment of the present invention in an assembled state.

FIGS. 1 through 10 illustrate an embodiment of a curved shower rod attachment assembly, which is designated hereinafter by reference numeral 100. The assembly 100 includes a first element 102, a second element 104, and a plurality of securing elements 106, 108, 110. At least one securing element 106 can connect the first element 102 and the second element 104 to each other and another securing element 108 can aid in connecting a curved shower rod to the assembly 100.

As illustrated in FIGS. 3-5 and 9, the first element 102 is plate that has a substantially rectangular shape and is adapted and configured to be attachable to a wall or like surface by securing elements 110. However, the first element 102 can take the form of any shape that is known or may become known that allows for secure attachment to a surface. The first element 102 can include a substantially planar first surface 112, a substantially planar second surface 114 that is spaced from and opposes the first surface 112, a first and a second shoulder 116, 118 defining a first channel 123, and a first and second end wall 120, 122 that extend transverse between opposing ends of the shoulders 116, 118.

Figure 4:
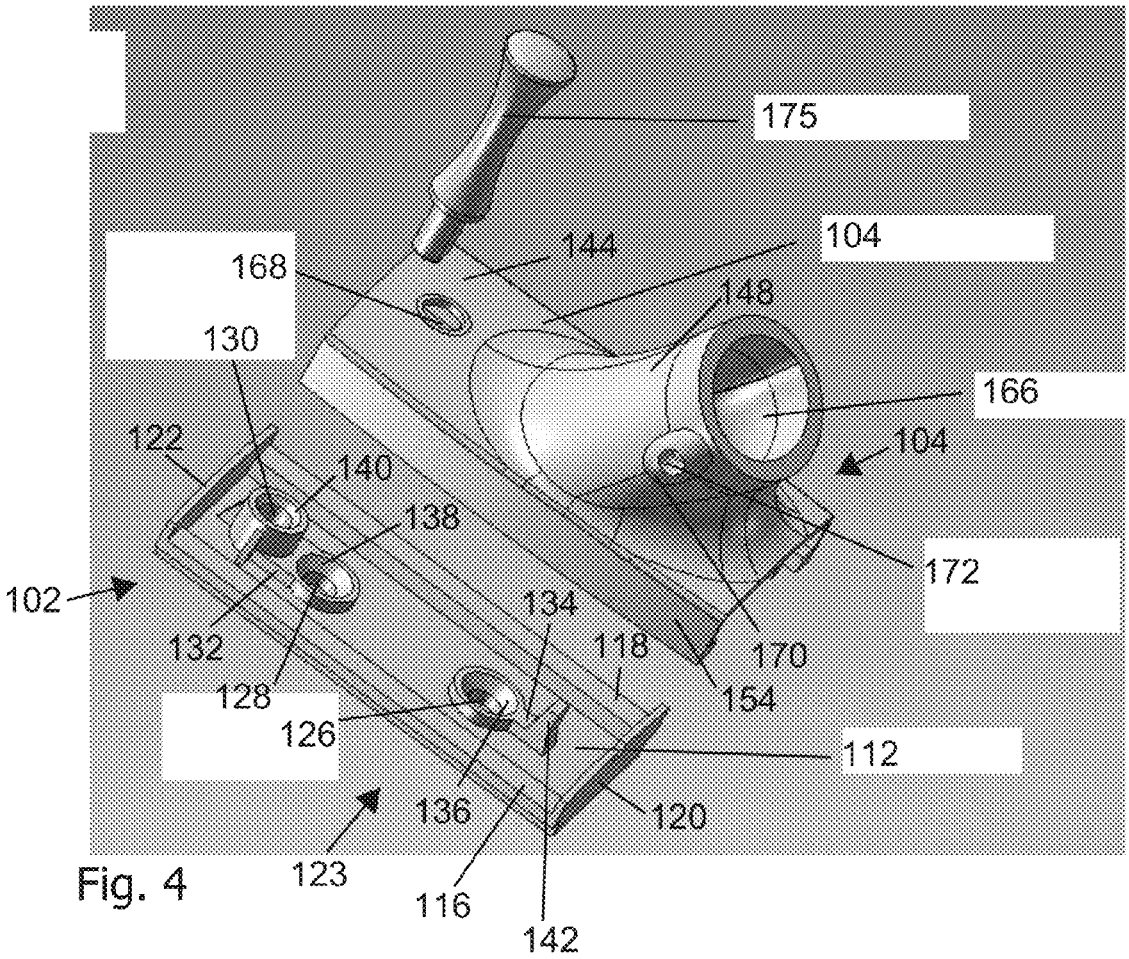
FIG. 4 is a second exploded perspective view of the curved shower rod attachment of FIG. 1.
Figure 5:
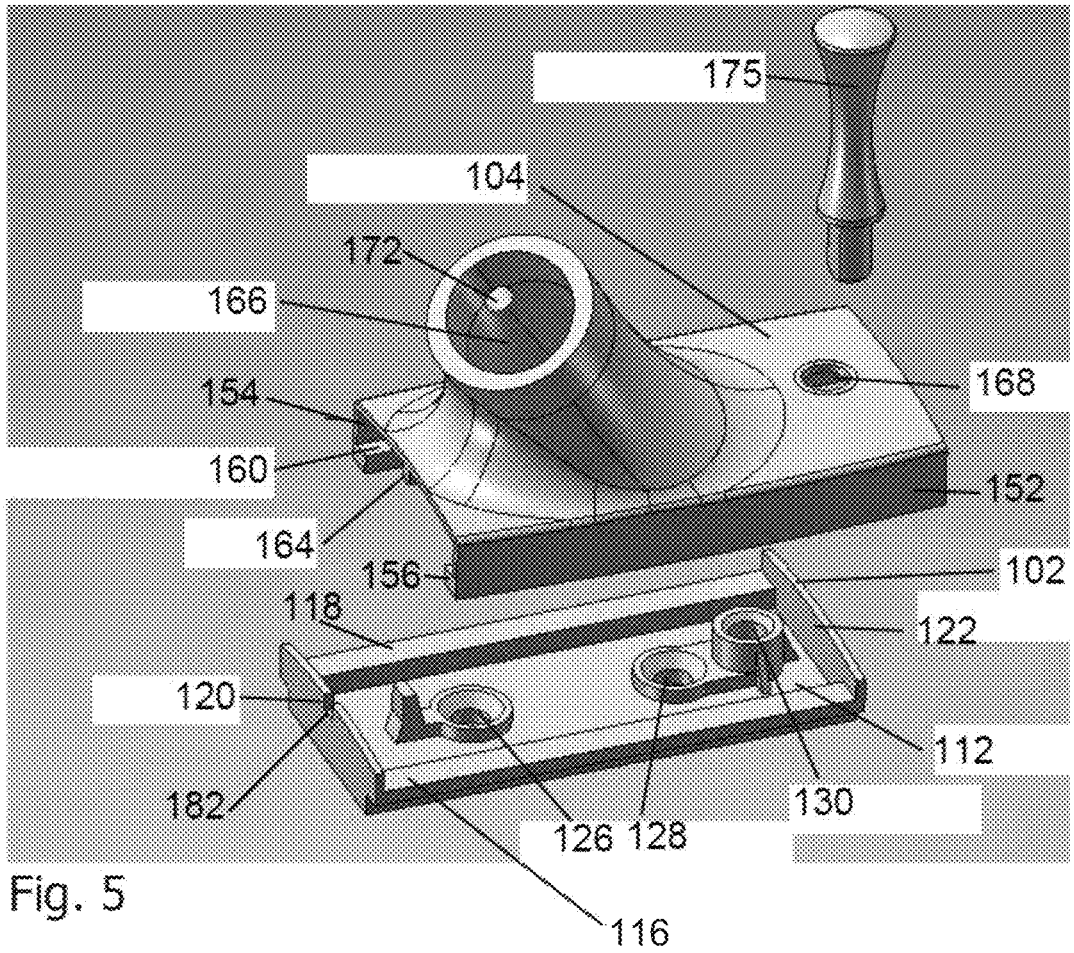
FIG. 5 is a third exploded perspective view of the curved shower rod attachment of FIG. 1.
Figure 6:
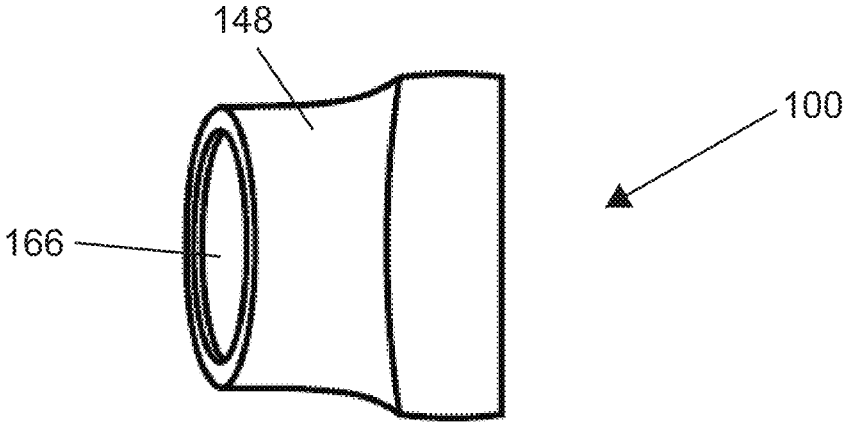
FIG. 6 is a perspective view of the rod opening of the curved shower rod attachment of FIG. 1.
Figure 7:
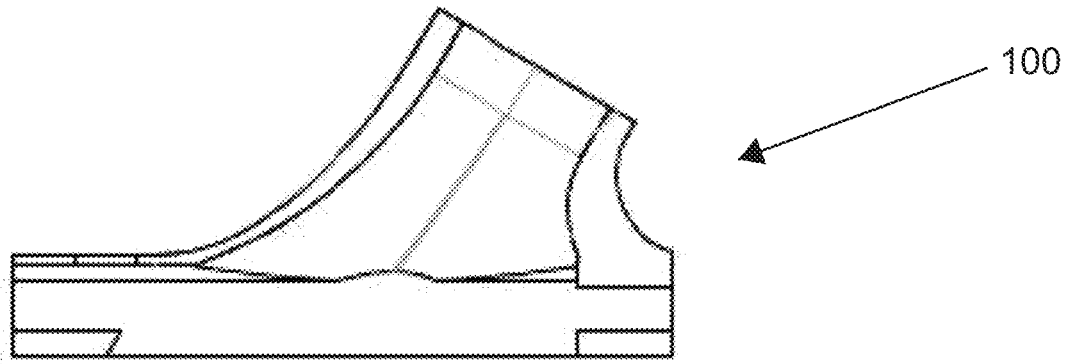
FIG. 7 is a first side view of the curved shower rod attachment of FIG. 1.
Figure 8:
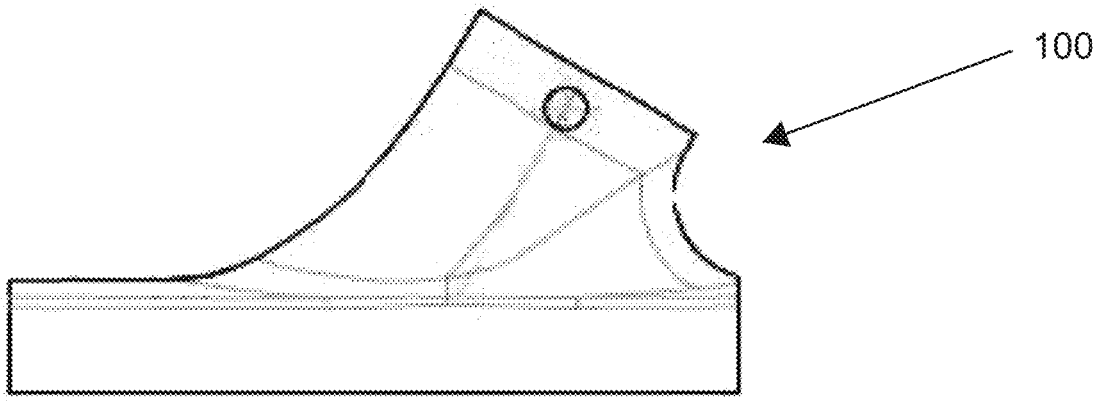
FIG. 8 is a second side view showing the opposite side of the curved shower rod attachment of FIG. 1.
Figure 9:
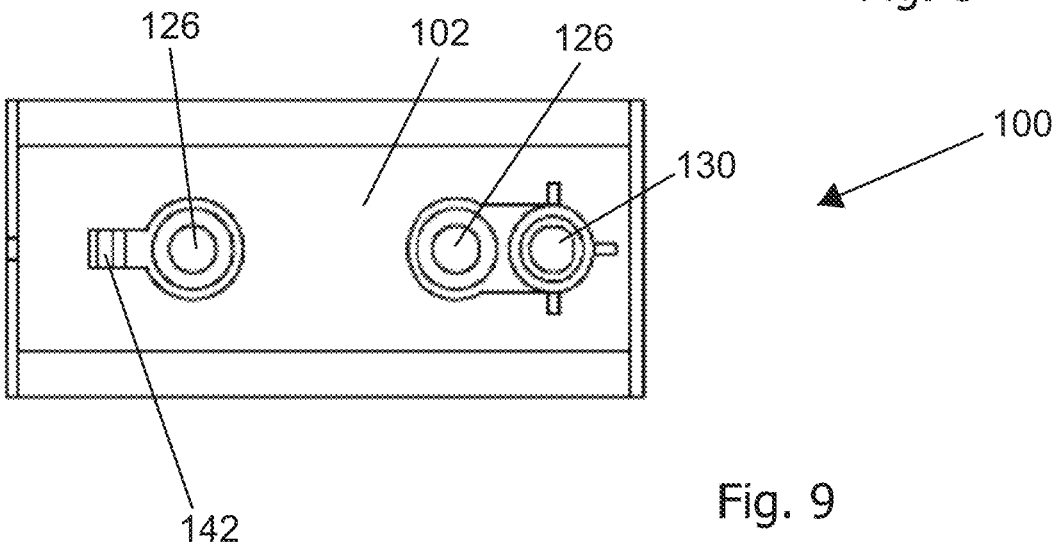
FIG. 9 is a bottom view of the curved shower rod attachment of FIG. 1.
Figure 10:
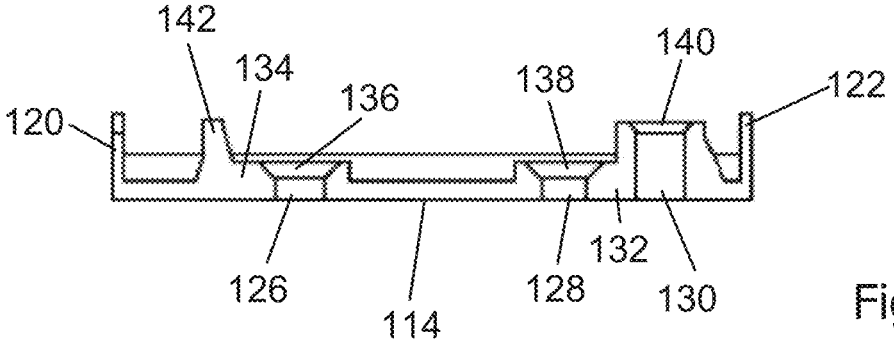
FIG. 10 is a side view of an embodiment of the first of the curved shower rod attachment of FIG. 1.

As shown in FIGS. 4 and 5, the first and second shoulder 116, 118 are spaced apart from each other and extend parallel to each other in a first direction, away and outwardly from the first surface 112, beyond a sidewall 124 that extends between the first surface 112 and the second surface 114. The first element 102 also includes a first, second, and third through opening 126, 128, 130. The first and second openings 126, 128 are spaced apart from each other and are adapted and configured to allow securing elements 106, such as screws, to extend therethrough to secure the assembly 100 to a wall or like structure. In an embodiment, as shown in FIGS. 4 and 5, protrusions 132, 134 that include chamfered surfaces 136, 138, 140 extend from the first surface at the openings 126, 128, 130, to provide additional surface area for the securing elements 108, 110. Additionally, a stop element 142 can extend outwardly from the first surface 112 for interaction with features of the second element 104 as will be described further below.

As can be seen in FIGS. 1-5, the second element 104 includes a first side 144, a second side 146, an angled protrusion 148 extending from the first side 144 and a second channel 150 extending from the second side 146. As will be described further below, the second channel 150 of the second element 104 is adapted and configured to be attachable to the first channel 123 of the first element 102.

The second channel 150 includes a first sidewall 152 and a second sidewall 154 that are spaced apart from each other and extend longitudinally from the second element 104 and a stopper 164 (see FIGS. 3 and 5) that extends from the second side 146 of the second element 104 between the sidewalls 152, 154. The first and second sidewalls 152, 154 each include a plurality of protrusions 156, 158, 160, 162 extending inwardly therefrom. That is, the protrusions 156, 158 from the first sidewall 152 extend toward the second sidewall 154 and the protrusions 160, 162 from the second sidewall 154 extend toward the first sidewall 152. As shown in an embodiment in FIGS. 3 and 5, the stopper 164 extends at one end of the inner surface 146 both longitudinally parallel to the sidewalls 152, 154 and vertically, away from the second side 146 of the second element 104, at a distance that does not exceed the height of the first or second sidewall 152, 154.

Figure 3:
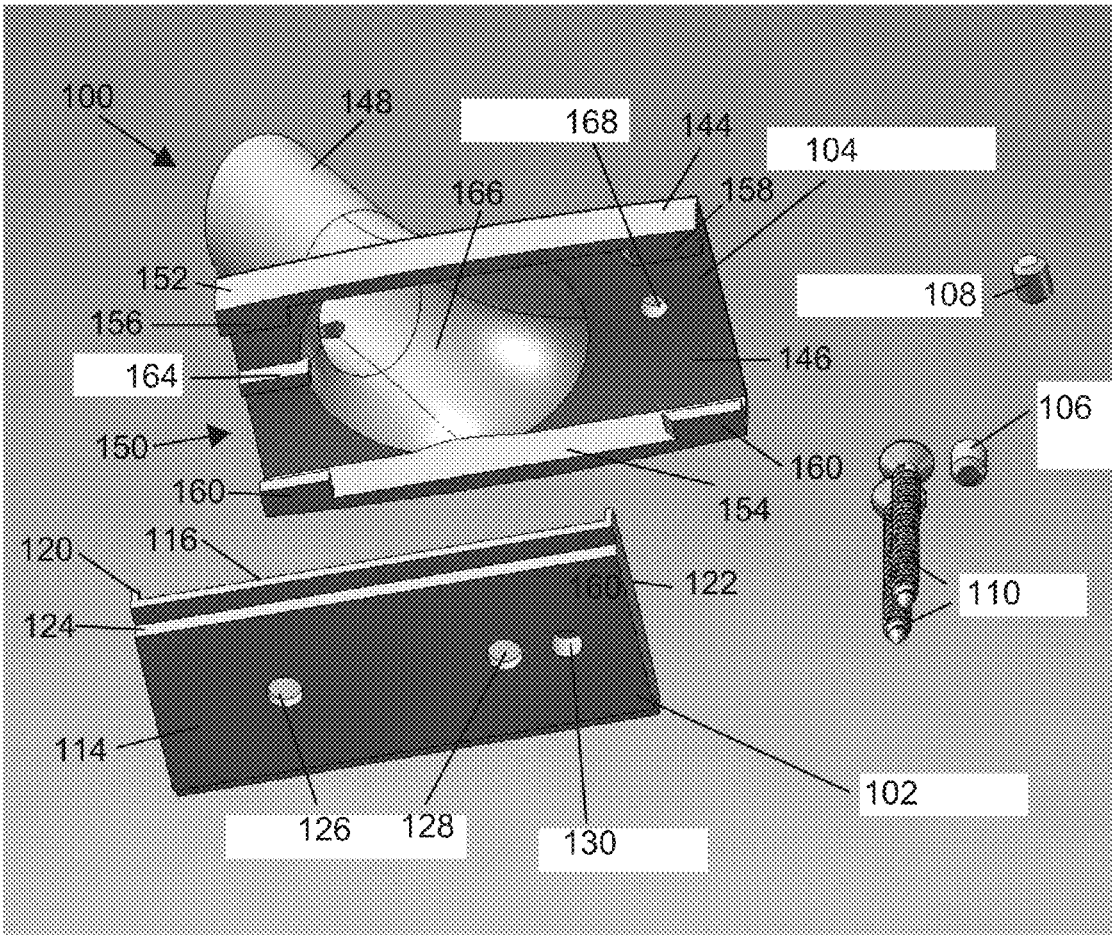
FIG. 3 is an exploded perspective view of the curved shower rod attachment of FIG. 1.

The protrusion 148 can include an opening 166 extending therethrough that is adapted and configured to receive a fastening element 108 to secure a shower rod within the opening 166 by any means that is known or may become known, including a threaded connection or by means of expansion to create a frictional connection. The protrusion 148 can take the form of a tubular body, a rectangular body, a square body or any other shape that can accommodate a shape of a shower rod. As shown in an embodiment in FIG. 3, the protrusion 146 is a tubular body that extends away from the first surface 144 at an angle. As shown in FIG. 3, the opening 166 flares outwardly as the opening 166 extends through the second element 104 from the first side 144 to the second side 146, allowing a shower rod to hinge within the opening 146 and to align properly with walls the assembly 100 can be mounted that may not be parallel. The assembly 100 keeps a curved shower rod secure and in a desired position by minimizing rotation and moment forces applied to the shower rod to preclude rotation and sagging. Thus, if the walls to which the assembly 100 is to be mounted are even slightly offset from each other, the rod can still be properly with the walls and the bracket can remain fixed to each wall without the need to act as a hinge. The fastening element 108 can include a pin, a screw, or any other securing means or combination thereof in compliance with U.S. or metric standards, that is known or may become known, which can secure a shower rod within the protrusion 146 upon an application of a tightening force in a first direction, but which also can allow the shower rod to be disengaged from the protrusion 146 if a sufficient force is applied to the fastening element 108 in a second direction that is opposite from the first direction. In an embodiment, the protrusion 146 can include a projection 170 having a through opening 172, which can be threaded, extending therethrough that is aligned with the opening 166 formed in the protrusion 146 to provide additional surface area for securing the shower rod within the protrusion 146. Alternatively, the protrusion 146 may be devoid of the protrusion 170 to provide a more aesthetically pleasing and streamline appearance and to prevent any interference with the flow of a shower curtain flow.

A second securing element 106, which can include a screw, a pin or any other securing means that is known or may become known, can be arranged within the opening 168 extending through the second element 104 that is aligned with the opening 130 that extends through the first element 102 upon an application of a tightening force in a first direction, but which also can allow the assembly 100 to be disengaged if a sufficient force is applied to the securing element 175 in a second direction that is opposite from the first direction. As illustrated in FIG. 4, the securing element may include an elongated part 175 that extends outwardly to act as a hook.

Figure 2:
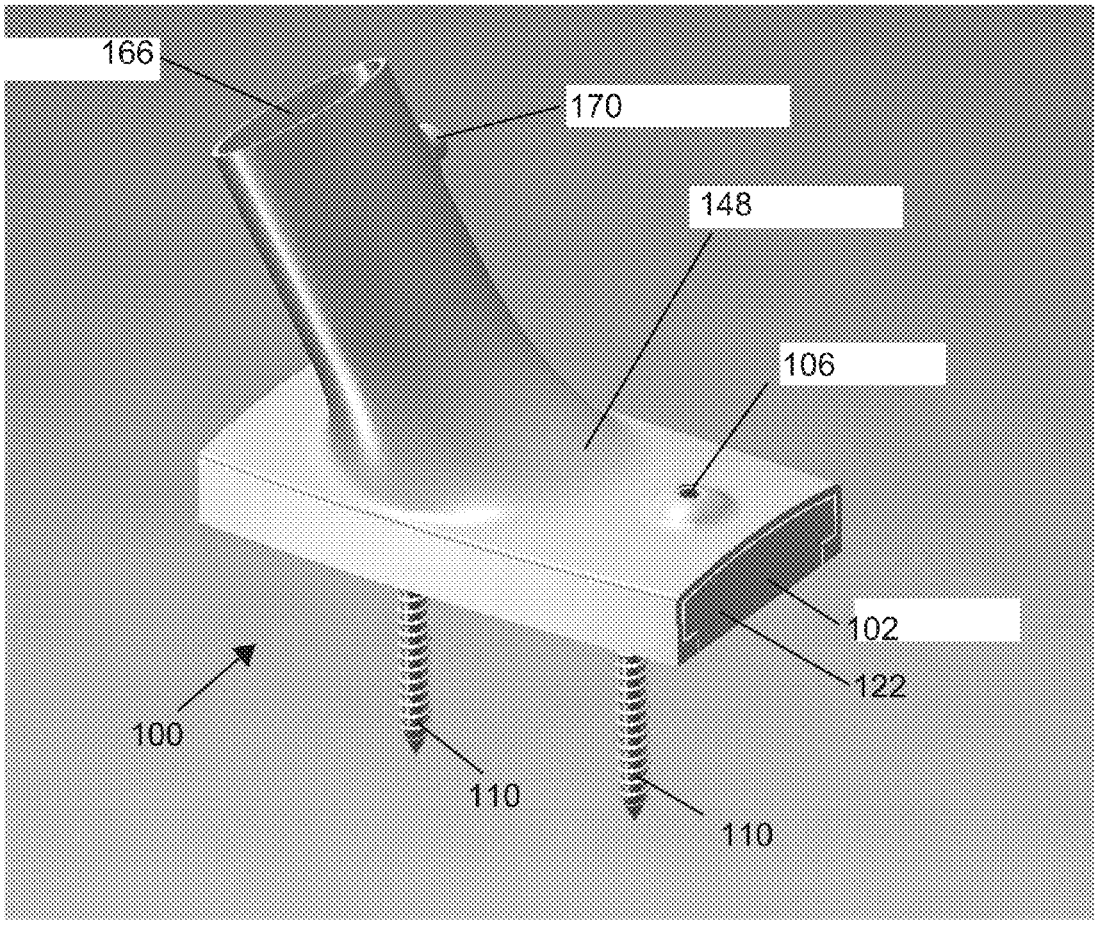
FIG. 2 is a second perspective view of the curved shower rod attachment of FIG. 1.

To assemble the first and second elements 102, 104, the first element 102 is orientated such that the shoulders 116, 118 comprising the first channel 123 are slid between openings 178, 180 defined by the sidewalls 152, 154 and protrusions 156, 158, 160, 162 that extend therefrom, until the stopper 164 of the second channel 150 passes through a recess 182 formed in one of the sidewalls 120 of the first element 102 and the stop element 142 of the first element 102 contacts the stopper 164 of second element 104 to ensure a properly aligned connection is achieved. The securing element 106 is then inserted the opening 168 in the second element 104 that is aligned with the opening 140 in the first element 102 to connect the first and second elements 102, 104 together. As shown in FIGS. 1 and 2, in an assembled state, the end walls 120, 122 of first element 102 are aligned flush with end faces 184, 186 of the second element 104, creating an aesthetically pleasing and streamline design.

The securing element 106 may include threads matching threaded openings 104, 168. Alternatively, the securing element 106 can be a pin that has a circumference slightly larger than the respective openings 140, 168 to allow the pin to maintain securement inside the openings 140, 168 by friction. Alternatively, a pin may be used that incorporates various locking mechanisms including a clip, a spring, a magnet, etc.

Figure 11:
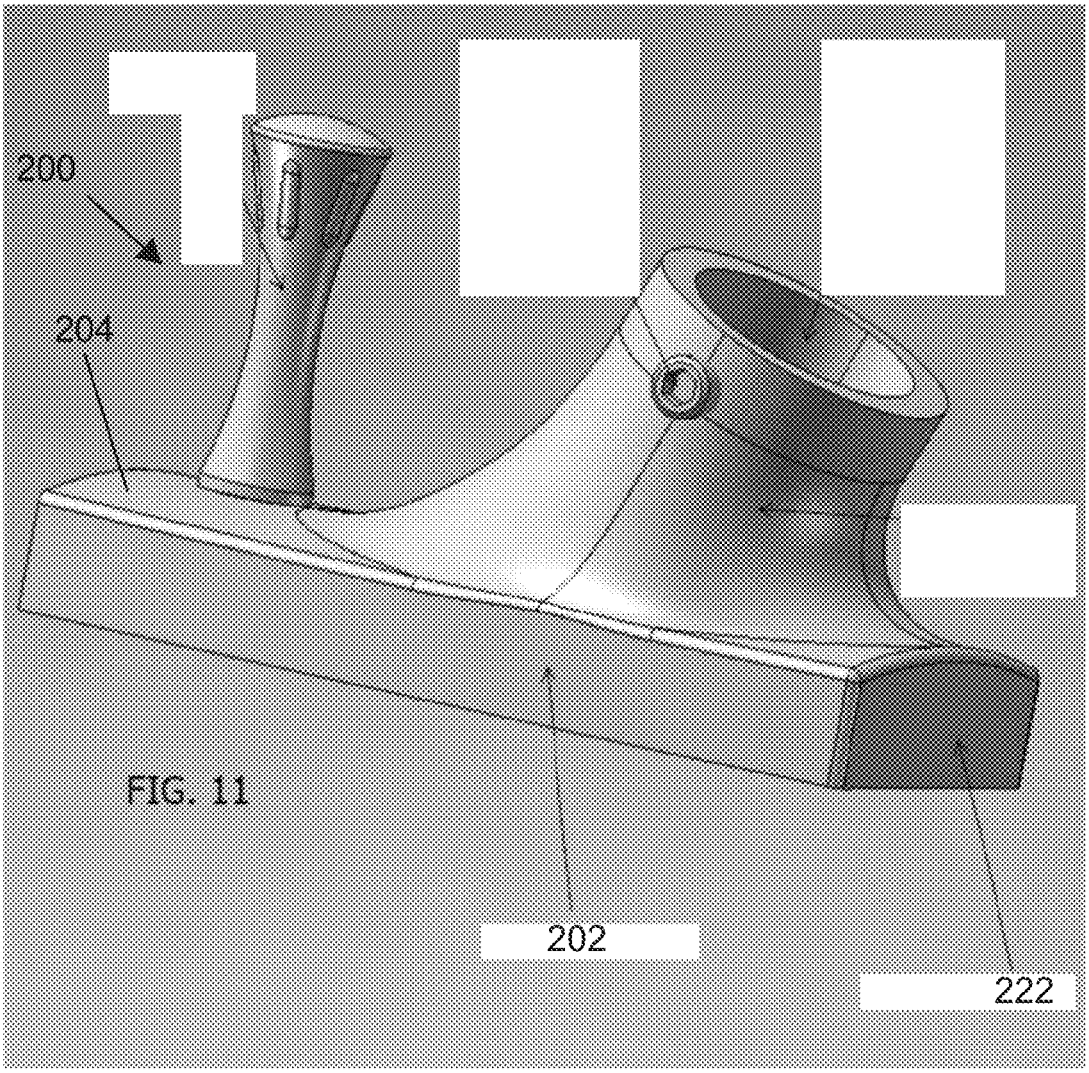
FIG. 11 is a perspective view of a second embodiment of a curved shower rod attachment of the present invention in an assembled state.
Figure 12:
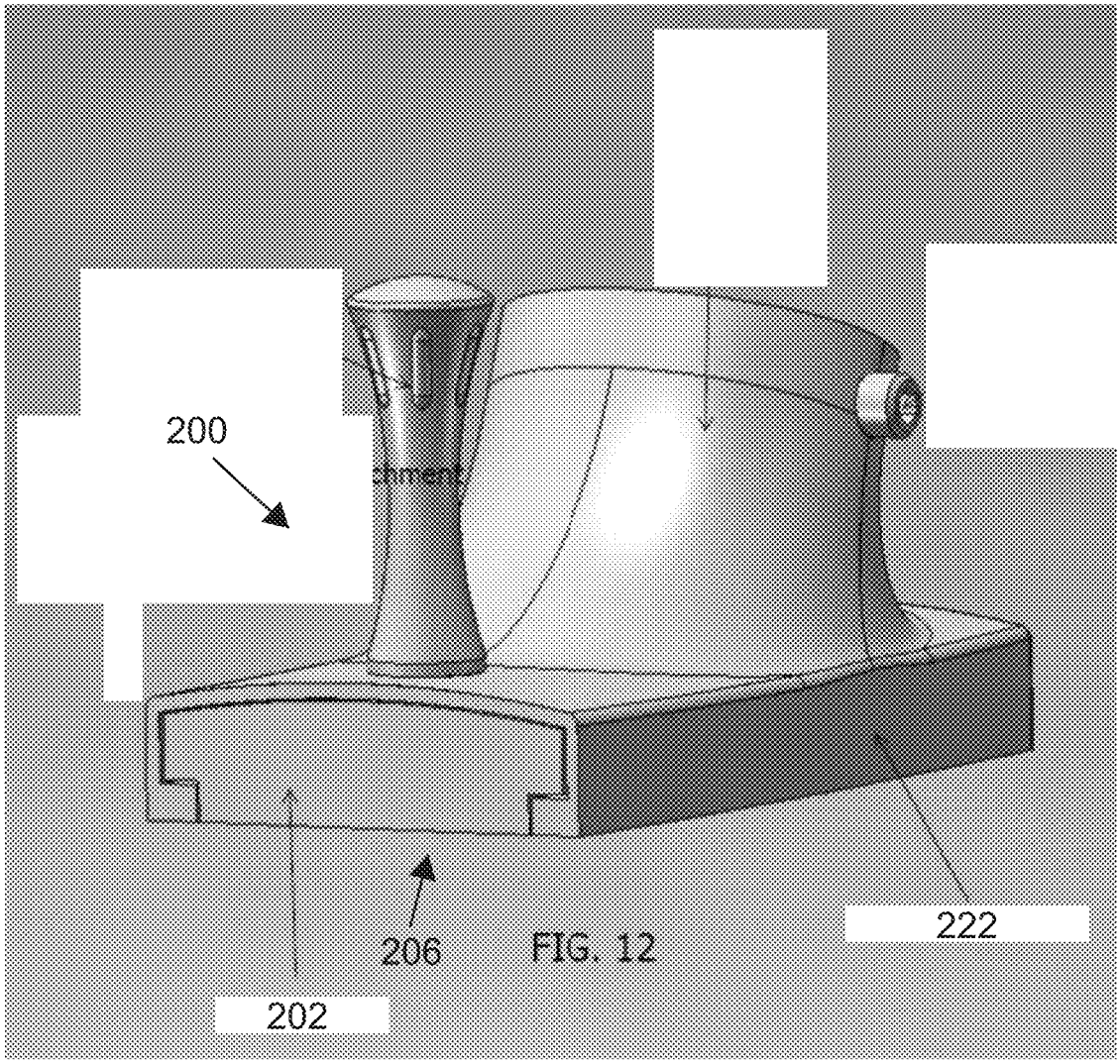
FIG. 12 is a second perspective view of the curved shower rod attachment of FIG. 11.
Figure 13:
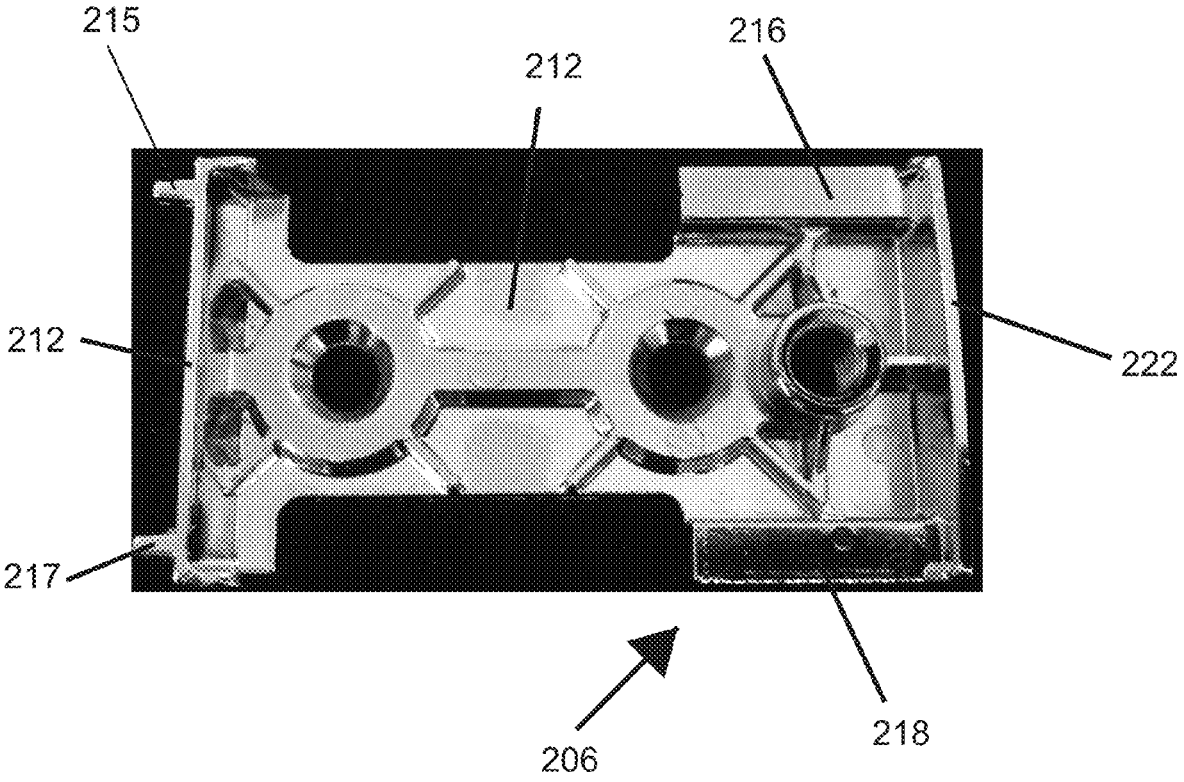
FIG. 13 is a perspective view of the first element of the curved shower rod attachment of FIG. 11.
Figure 14:
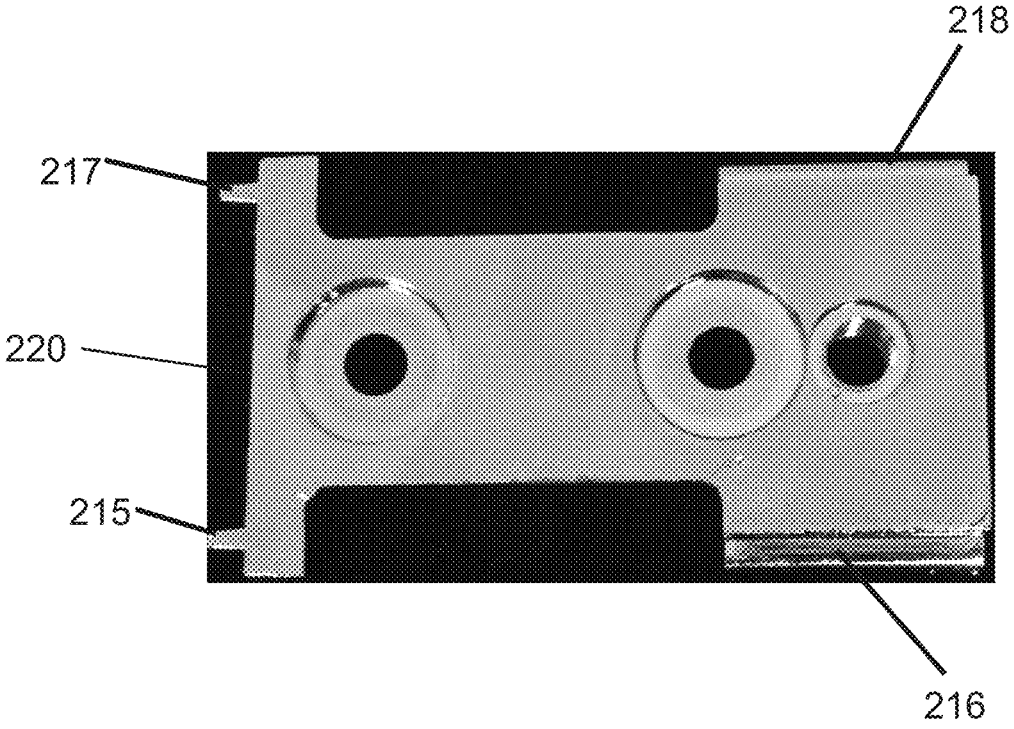
FIG. 14 is a bottom view of the first element of the curved shower rod attachment of FIG. 11.

FIGS. 11 through 14 illustrate a second embodiment of a curved shower rod attachment assembly 200. Similar to assembly 100, the assembly 200 includes a first element 202 and a second element 204. The first element 202 includes a first channel 206 and the second element 204 includes a second channel 208. The first channel 206 can include a first shoulder 216 and a second shoulder 218 that extend parallel to each other, away from a first surface 212 of the first element 202 and outwardly from the first surface 212. In an embodiment, the shoulders 216, 218 can extend longitudinally less than half of the length of the first element 202 to reduce weight, cost of production, and ensure proper assembly when the first element 202 is assembled with the second element 204. Additionally, the first element 202 can include a first end wall 220 that can extend at an angle at the first end of the first element 202, away from the shoulders 216, 218. The first element can further include protrusions 215, 217 that are spaced inwardly from the outer edges of the end wall 220, and can extend from the end wall 220 at an angle identical to the angle at which the end wall 220 is orientated. The protrusions 215, 217 can aid in aligning the first element 202 with the second element 204 in an assembled state to prevent lateral movement between the elements 202, 204. In combination with the shoulders 216, 218, the protrusions 215, 217 are designed to address forces applied to the assembly 200 in all directions. Further, as can be seen in FIG. 11, the second element 204 includes a solid front edge 222 behind which the two channels 206, 208 can be found to provide a more aesthetically pleasing appearance.

The accompanying drawings only illustrate embodiments of an attachment assembly and their respective constituent parts. However, other types and styles are possible, and the drawings are not intended to be limiting in that regard. Thus, although the description above and accompanying drawings contains specificity, the details provided should not be construed as limiting the scope of the embodiments, but merely as providing illustrations of some of the embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

What is claimed is:

1. A curved shower rod attachment, comprising:

a mounting plate adapted and configured for attachment to a surface; and a housing securable to the mounting plate and including a first sidewall, a second sidewall spaced from the first sidewall and extending substantially parallel to the first sidewall longitudinally about the housing, a top wall extending between the first sidewall and the second sidewall and including a first surface, a second surface opposing the first surface, an opening extending between the first surface and the second surface and a protrusion extending at an angle along an axis from the top wall, encompassing the opening in the top wall and including a body that is delimited by a first end and a second end and having an opening extending along the axis, between the first end and the second end of the protrusion, that is configured to receive a shower rod, wherein at least the first end of the protrusion curves outwardly from the axis such that the opening in the protrusion is larger at the first end, which extends from the top wall, than the second end, which is spaced from the top wall, allowing the shower rod to be received within the opening in the protrusion and pivot within the opening such that the shower rod and the housing intersect and interlock at diverging angles.

2. The curved shower rod attachment of claim 1, wherein the housing is delimited at a first end by a first end face and at a second end by a second end face with the first end face and the second end face being spaced from each other and extending transverse between the first sidewall and the second sidewall of the housing and the protrusion sloping at an angle at least toward the first end face and second end face of the housing.

3. The curved shower rod attachment of claim 1, wherein the mounting plate includes a body that has a base with a first shoulder and a second shoulder that are spaced apart from each other and that extend at a respective first end thereof from the base, substantially parallel to each other, in a first direction and extend at a second end, in a second direction, outwardly from the base.

4. The curved shower rod attachment of claim 3, wherein the mounting plate includes a first end face and a second end face and the first end face and the second end face extend transverse to the first shoulder and the second shoulder.

5. The curved shower rod attachment of claim 1, wherein the mounting plate has a substantially rectangular shape.

6. The curved shower rod attachment of claim 1, wherein the mounting plate includes a plurality of openings for securing elements to extend therethrough to secure the mounting plate to a wall.

7. The curved shower rod attachment of claim 1, wherein the mounting plate includes at least one opening that is internally threaded.

8. The curved shower rod attachment of claim 1, wherein the housing includes a second opening extending between the first surface and the second surface of the top wall thereof and one of the plurality of openings of the mounting plate is alignable with the second opening of the housing in an assembled state.

9. The curved shower rod attachment of claim 1, wherein the mounting plate and the housing are secured to each other by a fastening element that is at least one of a screw, a pin, a bolt or a clip.

10. The curved shower rod attachment of claim 1, wherein the housing includes a plurality of protrusions that extend inwardly from the first sidewall and the second sidewall defining a first channel and a second channel, respectively.

11. The curved shower rod attachment of claim 1, wherein the mounting plate is arranged within and substantially encompassed by the housing in an assembled state.

12. The curved shower rod attachment of claim 1, wherein the housing includes at least one stop element extending from the second surface, between the first sidewall and the second sidewall, to ensure alignment of the housing and the mounting plate in an assembled state.

13. The curved shower rod attachment of claim 1, wherein the housing includes a second opening extending between the first surface and the second surface of the top wall of the housing, the mounting plate includes a threaded opening that is alignable with the second opening in an assembled state and the curved shower rod attachment further comprises a securing element that is configured to be inserted into the second opening of the housing and threaded opening of the mounting plate in the assembled state to fix the housing to the mounting plate and ensure an interlock between the mounting plate, the housing and the securing element at diverging angles of intersection.

14. A method of assembling a curved shower rod attachment, comprising the following steps:

providing a curved shower rod attachment comprising a mounting plate, a housing including a first sidewall, a second sidewall that is spaced from the first sidewall and extends substantially parallel to the first sidewall longitudinally about the housing, a top wall extending between the first sidewall and the second sidewall and including a first surface, a second surface opposing the first surface, an opening extending between the first surface and the second surface and a protrusion extending at an angle along an axis from the top wall, encompassing the opening in the top wall and including a body that is delimited by a first end and a second end and has an opening extending along the axis, between the first end and the second end of the protrusion, that is configured to receive a shower rod, at least the first end of the protrusion curves outwardly from the axis such that the opening in the protrusion is larger at the first end, which extends from the top wall, than the second end, which is spaced from the top wall;

securing the mounting plate to a surface;

aligning the housing and mounting plate to each other; and fastening the housing to the mounting plate.

15. The method of claim 14, wherein the mounting plate includes a base with a first shoulder extending from a first side of the base and a second shoulder extending parallel to the first shoulder from a second side of the base and the housing includes a first protrusion extending substantially perpendicular from the first sidewall and a second protrusion extending substantially perpendicular from the second sidewall of the housing, the first protrusion and the second protrusion extending toward each other and defining a first channel and second channel within the housing.

16. The method of claim 15, further comprising the step of sliding the housing about the mounting plate such that the first shoulder and the second should of the mounting plate are arranged, respectively, within the first channel and the second channel of the housing.

17. The method of claim 14, further comprising the step of arranging a shower rod within the opening of the protrusion and securing the shower rod at a desired position within the protrusion.

18. The method of claim 14, further comprising the step of inserting a shower rod into the opening in the protrusion with the shower rod pivotable within the opening in the protrusion and the shower rod and the housing intersecting and interlock at diverging angles.

19. The method of claim 14, wherein the housing includes a second opening extending between the first surface and the second surface of the top wall thereof, the mounting plate includes a threaded opening and the curved shower rod attachment curved shower rod attachment further comprises a securing element that is configured to be inserted into the second opening of the housing and threaded opening of the mounting plate.

20. The method of claim 19, wherein the mounting plate is secured to a surface at a first angle, the housing is aligned with the mounting plate at a second angle and the securing element is inserted into the second opening of the housing and subsequently inserted into the threaded opening of the mounting plate, fastening the housing to the mounting plate and ensuring an interlock between the mounting plate, the housing and the securing element at diverging angles of intersection.

* * * * *